United States Patent [19]

Langford et al.

[11] Patent Number: 4,739,594

[45] Date of Patent: Apr. 26, 1988

[54] GAZEBO STRUCTURE AND METHOD OF ASSEMBLING THE SAME

[76] Inventors: John D. Langford, 205 Virginia St.; Matthew R. Lindsay, 2320 Grant St., both of Bellingham, Wash. 98225

[21] Appl. No.: 941,092

[22] Filed: Dec. 12, 1986

[51] Int. Cl.[4] ..... E04B 7/00; E04H 1/12

[52] U.S. Cl. ..... 52/82; 52/79.4

[58] Field of Search ..... 52/82, 79.4, 79.6, 702, 52/245, 246

[56] References Cited

U.S. PATENT DOCUMENTS

| | | | |
|---|---|---|---|
| 1,116,244 | 11/1914 | Conner . | |
| 1,246,281 | 1/1917 | Knack . | |
| 2,990,590 | 7/1961 | Graveley | 52/702 |
| 3,423,898 | 1/1969 | Tracy et al. | 52/702 X |
| 3,601,428 | 8/1971 | Gilb | 52/702 X |
| 3,633,325 | 1/1972 | Bartoli | 52/79.4 X |
| 3,807,101 | 4/1974 | Cole | 52/82 X |
| 3,908,329 | 9/1975 | Walters | 52/82 X |
| 4,192,107 | 3/1980 | Wickstrom | 52/82 |
| 4,332,116 | 6/1982 | Buchanan | 52/82 |
| 4,426,814 | 1/1984 | Stuhmer | 52/82 |

*Primary Examiner*—J. Karl Bell

*Attorney, Agent, or Firm*—Hughes, Cassidy & Multer

[57] ABSTRACT

A gazebo structure having an octagonal configuration with a base structure comprising corner posts and side panels. The roof comprises a plurality of triangularly shaped roof sections having radially extending beams at edge portions thereof. There is an apex center piece having a plurality of U-shaped mounting brackets, with each bracket receiving therein the apex ends of two adjacent side beams from two adjacent roof sections. The roof sections are prefabricated and can be erected into the completed roof quickly and conveniently.

18 Claims, 3 Drawing Sheets

GAZEBO STRUCTURE AND METHOD OF ASSEMBLING THE SAME

BACKGROUND OF THE INVENTION

1. Field of the Invention

The present invention relates to a gazebo structure made from premanufactured components which can conveniently and easily be assembled into the finished structure, and also to a method of accomplishing the same.

2. Background Art

Gazebo structures are often provided as auxiliary structures for a variety of recreational, quasi-recreational, and/or aesthetic reasons. Quite commonly, the plan form of such a gazebo is that of a regular polygon, having more than four sides, such as a hexagon or an octagon. The configuration of the roof is generally made up of a plurality of triangular shapes, with each triangular shape extending from a peripheral base upwardly and inwardly toward a center apex point.

Because of the geometry of the common gazebo structure, the problems of cutting or forming the various components and then joining them together are somewhat more complex then, for example, building a structure where most of the components join to one another at right angles. Accordingly, there exists a need to provide a gazebo structure whichi is aesthetically pleasing, but which can be conveniently and easily erected.

A search of the U.S. patent literature has disclosed a number of patents, these being the following:

U.S. Pat. No. 4,426,814—Stuhmer shows a prefabricated gazebo where there are six roof sections, each having a kite-shaped configuration. The roof sections meet at a center location, and the inside or center portion of each roof section is made as a circularly curved portion, with the several portions being connected together to form a circle and joining to a center circular or cylindrical member. The side edges of the kite-shaped roof sections are first loosely bolted together, and then joined to the center member.

U.S. Pat. No. 4,192,107—Wickstrom shows what is called a "Conical Roof Structure", where there are a plurality of substantially identical metal roof sections having U-shaped ribs 38 along each edge portion. The rib from one section fits over an adjacent rib of the next section, and a stiffener is connected to the two overlapping ribs. The upper inner end portions of each roof section join at a center location. There is provided a circular center piece having a downwardly and outwardly extending frusto-conical skirt to which the roof member is joined.

U.S. Pat. No. 3,908,329—Walters shows a polygonal building construction where there is shown in FIGS. 6 and 7 a center mounting ring that has downwardly and outwardly extending plates to support rafters that extend radially outwardly and downwardly from the center location.

U.S. Pat. No. 3,807,101—Cole shows in FIG. 5 a portion of the roof structure where there is a center hexagonally shaped member, to which support beams 55 are connected. Parallel spaced brackets or plates 49 are welded to the hexagonal member to form outwardly facing slots to receive the inner ends of the beams 55.

U.S. Pat. No. 3,633,325—Bartoli shows a building structure having a central support column 35 and a roof-to-column connector 39. There are rafter members 63 having inner ends secured to the column connector 39.

U.S. Pat. No. 3,601,428—Guilb shows a joist hanger which has a pair of mounting flanges and a hanging portion having a U-shaped configuration to receive the end of the joist.

U.S. Pat. No. 3,423,898—Tracy et al. shows a rafter securing device in which a member defining a U-shaped slot is used to support the rafter.

U.S. Pat. No. 2,990,590—Graveley shows a roof rafter saddle tie, where there is a U-shaped member to receive the end of the rafter.

U.S. Pat. No. 1,246,281—Knack shows a silo where the roof has upwardly and inwardly extending rafters that join at a center location. There is a center member defining a recess to receive the inner ends of the rafters 33.

U.S. Pat. No. 1,116,244—Conner shows a circular metal roof where the inner ends of the angle bars can be connected to a center member in a manner to eliminate as much as possible fastening members such as bolts or rivets. This center member forms a series of radial sockets 11 defined by a lower skirt 8 and an upper skirt 11 having a somewhat corrugated configuration.

SUMMARY OF THE INVENTION

The present invention comprises a building assembly adapted for quick erection into a finished building structure. The present invention also relates to the building structure itself, and also a method of assembly.

The building assembly of the present invention comprises a side support structure adapted to be erected in a configuration defining a perimeter of the structure, and further defining a plurality of support locations positioned around the perimeter. There is also a roof center piece adapted to be positioned at an apex location within the perimeter.

There is a plurality of roof sections, each of which has a base portion of a greater width dimension, and an apex portion of a lesser width dimension. There are also first and second side portions extending from opposite ends of the base portion inwardly toward one another to the apex portion. Each roof section has a longitudinal center axis extending from a middle location of the base portion to the apex portion. The roof sections are adapted to be placed in the assembled position in side-by-side relationship around the apex location to form a roof structure, with each roof section having its base portion at a respective support location of the perimeter frame and its apex portion adjacent the roof center piece, and with its longitudinal axis extending radially from the apex location.

Each roof section has first and second elongate side beams positioned at the first and second side portions of the roof section. Each beam has a base end at the base portion and an apex end at the apex portion, and each beam also has a laterally and outwardly facing contact face. The contact face of a first beam of each roof section is positioned adjacent the contact face of a second beam of an adjacent roof section when the roof sections are in the assembled position. Further, the apex portions of the first and second adjacent beams are adjacent one another and have a predetermined width dimension.

The center piece has a plurality of mounting elements positioned around a perimeter of the center piece. Each mounting element has a pair of side flange portions defining an outwardly facing receiving slot of a predetermined horizontal width dimension sized to receive in close-fitting relationship a pair of of apex portions of adjacent first and second beams.

The assembly is characterized in that with the assembly in the assembled position, each of the mounting elements of the center piece is positioned between the longitudinal axes of two adjacent roof sections in a position to receive the apex ends of two first and second beams of adjacent roof sections. Further, the first and second apex portions of beams of any one roof section fit in adjacent mounting brackets.

In the preferred form, each mounting element further has a lower flange portion that extends radially outwardly in a downward slant to engage lower slanted surfaces of apex portions of first and second beams positioned in the slot. Also, in the preferred form, each mounting element comprises a back mounting plate by which that mounting element is mounted to the center piece.

Further, in the preferred form, the center piece comprises a hub portion having a plurality of generally vertical planar outwardly facing surfaces positioned around a perimeter of the hub. Each of the mounting elements has a generally U-shaped configuration, and the planar back plate is connected to the flange portion and is mounted directly to a related one of the planar surfaces of the hub.

Also in the preferred form, the side support structure comprises a plurality of posts adapted to be vertically aligned in the assembled position. Each post has an upper support end engaging in support relationship a related pair of first and second beams of two adjacent roof sections. At least some of the posts have generally planar side surface portions. Further, the assembly comprises panel sections which in the assembled position are positioned between two related posts. Each panel section has side planar surfaces engaging a related two of said posts, in a manner that the side surfaces of the panel sections engaging the side surfaces of the posts position the posts and the panels in the configurations that defines the perimeter of the structure.

In the preferred form, the configuration defining the perimeter of the structure is a regular polygon, having side perimeter defining lines and corner locations, with each of the posts being positioned at a corner location. Each post is positioned so that side surfaces of each post are generally radially aligned with the apex location.

In the method of the present invention, the side support structure is erected. In the specific embodiment shown herein, this is accomplished by placing the posts at corner locations of the polygon defined by the side support structure. Panel sections are connected between the posts as indicated above to form the completed side support structure.

Then at least one roof section is connected to the roof center piece, and this roof section is positioned with the base portion thereof being supported at a support location of the side structure. Then a second roof section (desirably an oppositely positioned roof section) is also connected to said roof center piece, with its base portion being supported at a support location diametrically opposed from the first roof section installed. Then additional roof sections are installed in a similar manner.

In the preferred form, fasteners (e.g. screws) are inserted through the mounting elements to secure the beams thereto, and fasteners are also provided to interconnect adjacent pairs of first and second beams.

Other features will become apparent from the following detailed description.

DESCRIPTION OF THE PREFERRED EMBODIMENT

Figure 1:
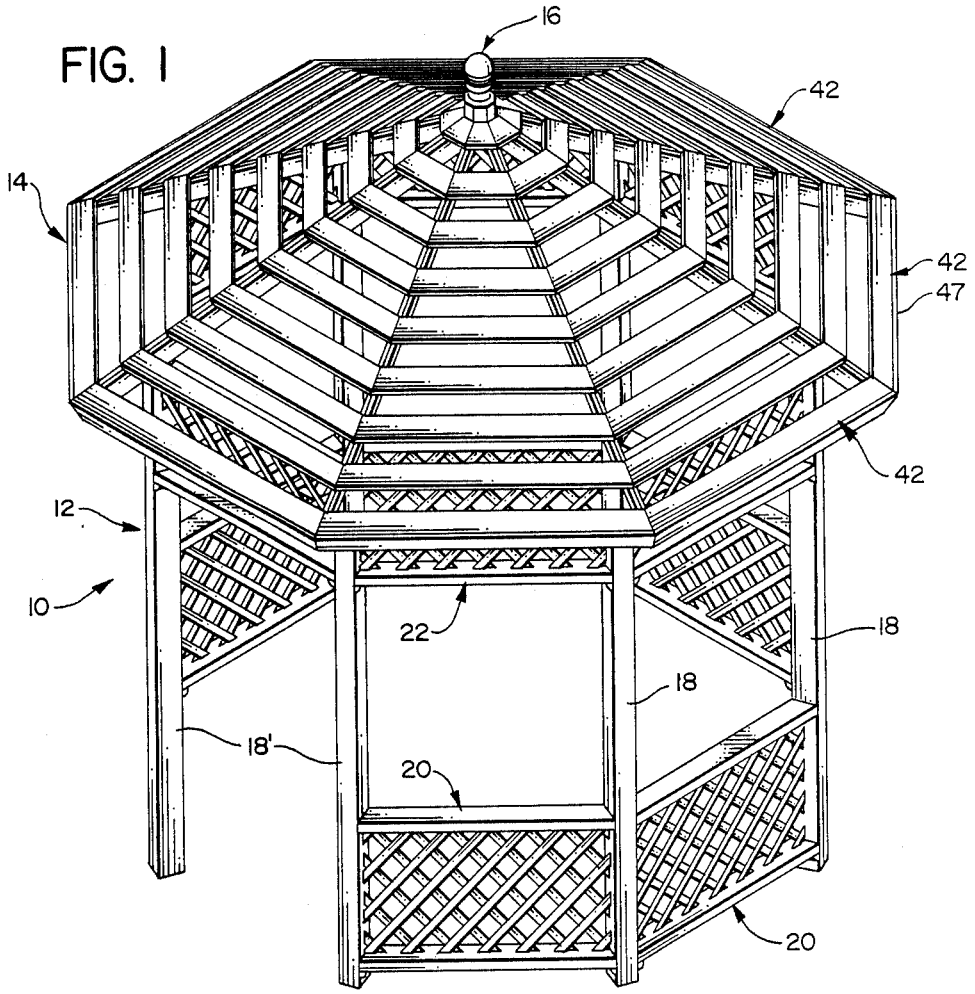
FIG. 1 is an isometric view of the gazebo structure of the present invention.
Figure 2:
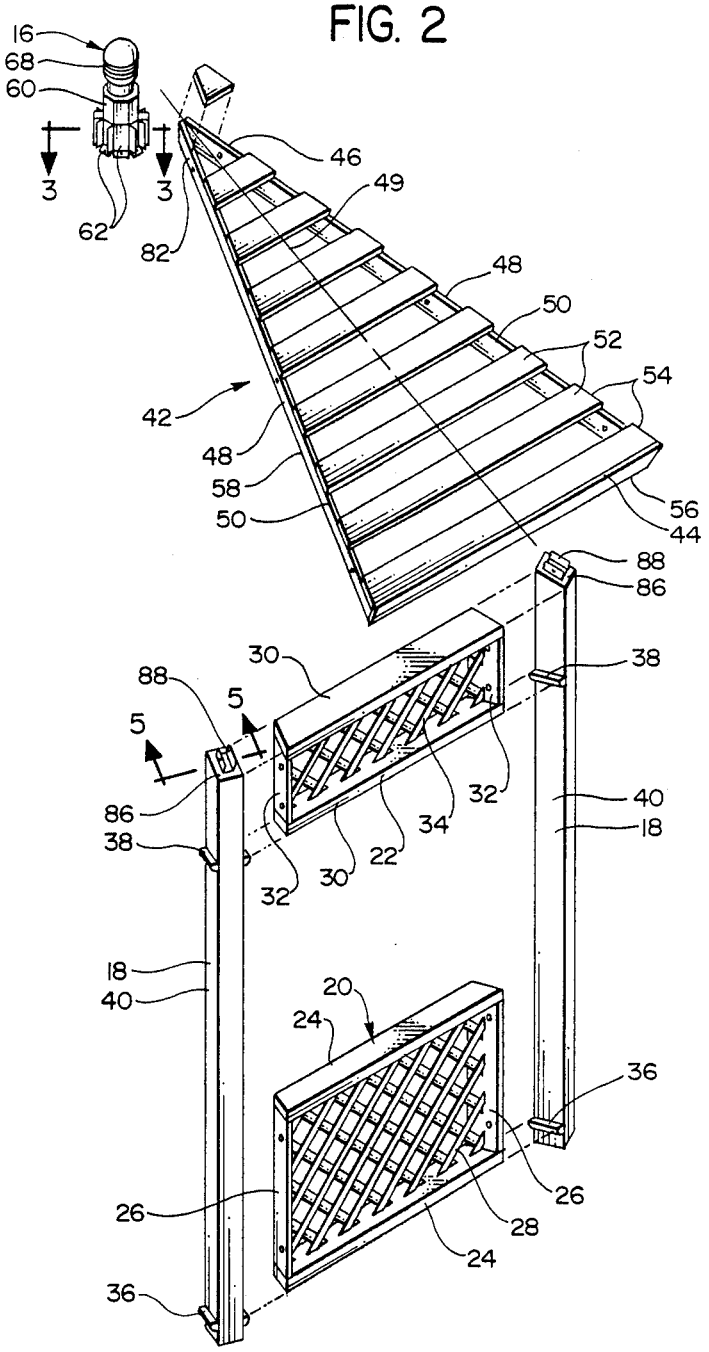
FIG. 2 is an isometric exploded view illustrating the center piece, a roof section, and one portion of the perimeter side wall structure.

The gazebo structure 10 of the present invention has three main components, namely a perimeter side wall structure 12, a main roof structure 14 and a roof center piece 16. The overall configuration of this gazebo structure is, in plan configuration, that of a regular polygon, and with this particular embodiment having octagonal configuration. The structure is such that it can be made almost entirely of wood, except for certain connecting members which are desirably made of metal.

The side wall structure 12 comprises primarily the following: eight support columns or posts 18, seven lower side wall sections or panels 20, and seven upper side wall sections or panels 22. Each of the posts 18 desirably has a rectangular cross-sectional configuration, and can be in the configuration of a four inch by four inch piece of lumber.

The seven lower side wall sections 20 are identical, and each has a rectangular configuration. Each side wall section 20 comprises upper and lower horizontally extending members 24 (e.g. made from two inch by four inch boards), and two side members 26 (e.g. one inch by four inch boards). The rectangular area defined by the four members 24–26 defines a rectangular area which in this particular embodiment is filled with a plurality of spaced diagonally extending members 28 arranged in a crossing pattern.

The upper side wall sections 22 also are identical, and each has the same overall configuration as the lower side wall sections 20, except that the vertical dimension of each upper side wall section 22 is made somewhat less than that of the lower sections 20. Thus, there are upper and lower horizontal members 30 and two vertically oriented side members 32, with these four members 30–32 arranged in a rectangular configuration. There is also a crossing network of diagonal board members 34, similar to those indicated at 28.

Each post 18 has on each side surface a lower and upper locating member 36 and 38, respectively, each member 36 and 38 extending outwardly a short distance to present an upwardly facing shoulder or locating surface to engage a lower edge portion of its related side wall section 20 or 22, respectively.

In the finished structure, the posts 18 are aligned so that a forward-to-rear axis of each post 18 (i.e. an axis lying in a plane parallel to the side surfaces 40 of each post 18) is directed toward the apex location or center of the octagon defined by the structure 10 (this center being the location of the roof center piece 16). To accomplish this, the side members 26 and 32 of the side wall sections 20 and 22 are angled or canted from a plane perpendicular to the horizontal members 24 and 30. Specifically, the side members 26 and 32 are positioned so that the outer surface of each of these members 26 and 32 makes an angle of 67½° with a plane defined by the rectangle of the lower side wall section 20 or the upper side wall section 22. Thus, when the side members 26 and 32 are pressed against the related side surfaces 40 of adjacent posts 18, the posts 18 automatically come into proper alignment relative to the center of the octagon.

The main roof structure 14 is made up of eight identical roof sections 42, each having a planform configuration of an isoceles triangle. Each roof section can be considered as having a base portion 44, an apex portion 46, and two side portions 48, which extend from opposite ends of the base portion 44 inwardly and upwardly to the apex portion 46. Each roof section has a longitudinal center axis extending from the middle of the base portion 44 to the apex portion 46.

Each roof section 42 has at the side portions 48 two radially extending side beams 50 which can be cut from, for example, a one inch by four inch board. The two side beams 50 of each roof section 42 are interconnected by laterally extending cross members 52, the ends 54 of which are connected (e.g. by nailing) to the top edges of the two side beams 50. To provide structure rigidity, and also for aesthetic reasons, a base member 56 is connected to the outer ends of the two side beams 50 and extends therebetween.

As will be disclosed more fully hereinafter, the eight roof sections 42 fit against one another in side-by-side relationship in a circular pattern, with each roof section 42 extending from its radially outward base portion 44 upwardly at a moderate slant and inwardly toward the apex 46. The outwardly facing side surface 58 of each side beam 50 fits against the outwardly facing side surface 58 of an adjacent side beam 50 of an adjacent roof section 42. To accomplish this close contacting face-to-face relationship of the surfaces 58 in a manner to accomplish the desired end roof configuration, the side beams 50 are slanted downwardly and inwardly to a moderate extent so that these form an angle with a plane defined by their related crossmembers 52 that is slightly less than a right angle.

The aforementioned center piece 16 comprises a wooden hub 60 and eight metal elements or brackets 62 particularly adapted for use in the present invention. The hub 16 has in plan view (see FIG. 3) the configuration of a regular octagon, and thus has eight vertically extending flat sides 64 which join at 135° corners 66. The upper end of the hub 60 can be formed in a decorative configuration, as at 68.

Figure 3:
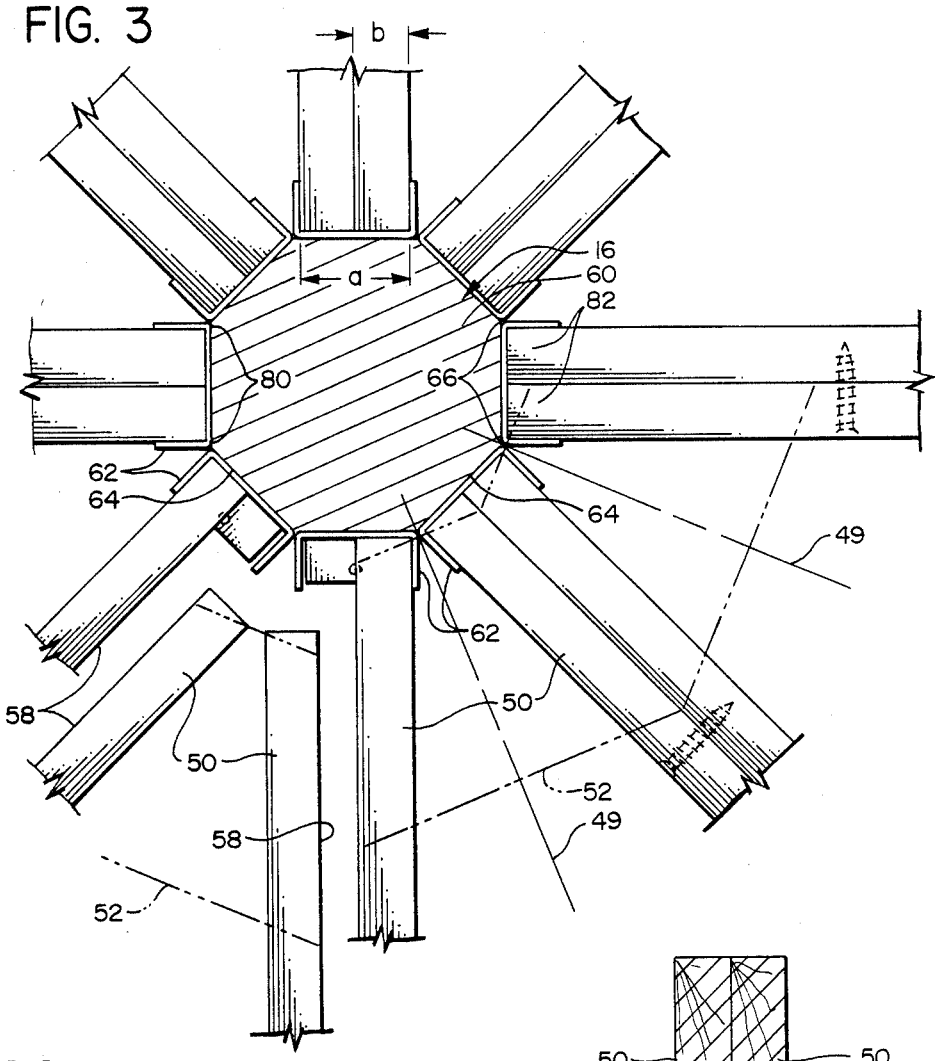
FIG. 3 is a sectional view taken along line 3—3 of FIG. 2, and showing the manner in which the beams of the roof sections are joined to the center piece.
Figure 4:
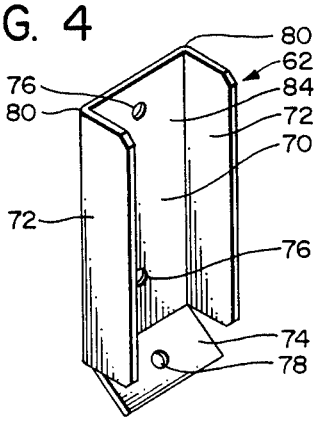
FIG. 4 is an isometric view of one of the mounting brackets b, which the roof sections are connected to the center piece.

As illustrated in FIG. 4, each bracket 62 has a general U-shaped configuration and comprises a back mounting plate 70, two side flanges 72, and a lower support flange 74. The mounting plate 70 is provided with two vertically spaced holes 76 to receive nails or screws to mount the bracket 62 to a related side surface 64 of the hub 60. The support flange 74 is provided with a similar hole or opening 78. The support flange 74 is slanted moderately downwardly in a radially outward direction to match the slope of the roof sections 42. The two side flanges 72 extend outwardly from the mounting plate 70 at a right angle to the plane occupied by the mounting plate 70. As can be seen in FIG. 3, the vertical edges 80 of the mounting plate 70 of each bracket 62 are very close (or nearly in contact with) the adjacent vertical edges 80 of adjacent brackets 62.

With further reference to FIG. 3, it should be recognized that the width or lateral distance between the inside surfaces of each pair of side flanges 72 of a bracket 62 (indicated at "a" in FIG. 3) is very close to the same as a quantity equal to twice the thickness (indicated at "b" in FIG. 3) of each of the side beams 50 of the roof sections 42. Thus, the inner or apex ends 82 of adjacent side beams 50 can fit snugly into a recess or socket 84 defined by two related side flanges 64 so as to hold the side beams 50 in close contact with one another. Further, the inner end or edge of each beam 50 is cut at a slant so that it can fit flush, against the mounting plate 70 of its related bracket 62.

Figure 5:
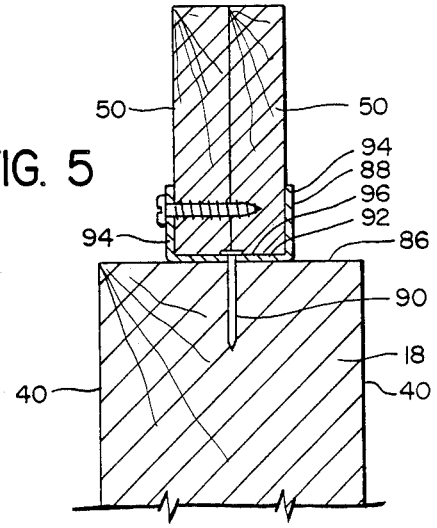
FIG. 5 is a sectional view taken along line 5—5 of FIG. 2.

The top surface 86 of each post 18 is cut at a moderate slant to match the slant of the side beams 50 which are to rest thereon. Further, a U-shaped bracket 88 is fastened (e.g. by nails 90) to the top surface 86 of each post 18. As shown in FIG. 5, each U-shaped bracket comprises a mounting plate 92 and two upstanding side flanges 94. The side flanges 94 are spaced from one another to define a recess 96 sized to receive snugly therein two adjacent side beams 50.

As indicated previously, the present invention lends itself to having its component parts very quickly and conveniently erected into an assembled structure. This is accomplished in the following manner. The component parts are delivered to the erection site with the eight roof sections 42 already fabricated. Likewise, the center piece 16 is preassembled, with the metal brackets 62 already connected to the hub 60. (The manner in which the brackets 62 with the hub 60 cooperate with the roof sections 42 is particularly critical in the present invention. For this reason, to insure that the brackets 62 are mounted to the hub 60 within proper tolerances, the center section 16 is preassembled at the factory. The four posts 18 and the side wall sections or panels 20 and 22 are delivered to the erection site as separate components, with the panel 20 and 22 each being preassembled.

The erection of the gazebo structure 10 can be accomplished quite conveniently by two persons working together. The only equipment required is an electric drill and a stepladder. (In the preassembled kit that is delivered to the erection site, a suitable drill bit and connecting screws are included.)

The first step is to erect the perimeter side wall structure. This is started by connecting the lower side wall sections or panels 20 to the posts 18. One person positions one of the posts 18, while the other places the lower section 20 against the post 18, with the lower stop member 36 properly locating the lower wall section 20. Screws are inserted through the side members 26 and into the posts 18. This procedure is continued until the seven bottom sections or panels 20 are attached to the posts 18 so that the posts 18 are positioned upright and the basic octagonal configuration of the assembly 10 is established. For convenience, it is usually desirable to start at one of the entry posts (indicated at 18' in FIG. 1) and to work around the structure to complete the assembly at the other entry post 18'. (The two entry posts 18' do not have the support members 36 and 38 on their surfaces 40 that define the entryway.)

Then the upper panel sections 22 are installed in substantially the same manner as the lower panels or sections 20.

To install the roof sections or panels 42, the first step is to connect the apex portion 46 of the first roof section 42 to be installed to the center piece 16. This is accomplished by placing the apex ends of the two side beams 50 into the recesses 84 defined by two adjacent mounting brackets 62, with one end of the beam 50 being in one recess 84 and the other in the other recess 85. The spacing of the brackets 62 is arranged, relative to the spacing of the apex ends of the beams 50 of each roof section 42 so that there is a snug friction fit between the beams 50 and the flanges 72 of the adjacent brackets 62.

Then the roof section is raised and placed on top of two posts 18 by placing the two beams 50 in the two brackets 88. (The bottom surface of the beams 50 can be provided with stop members to properly locate the roof section 42.) This can be accomplished by the second person standing on a stepladder and supporting the apex end 46 of the roof section 42, while the first person places the base portion 44 of the roof section 42 onto the posts 18.

While the second person is still holding the apex portion 46 of the roof section 42 in place (with the center piece 16 being attached thereto), a second roof section is installed at a location diametrically opposite to the first roof section 42 that is in place. Then the apex end of that second roof section 42 is placed in contact with the center piece 16 by inserting the apex ends of the two beams 50 of that second section in two related mounting brackets 62. With this accomplished, these first two installed roof sections will provide support for one another and remain in place. Then additional roof sections are added in the same manner as described above. Desirably, the next two roof sections 42 are installed so as to be positioned at right angles to the first two roof sections 42 that were installed.

When all the roof sections 42 are in place, adjacent side beams 50 from adjacent roof sections 42 are positioned side-by-side and in contact with one another, and adjacent side beams 50 from two adjacent roof sections 42 fit into a common metal bracket 62, and into a common post-mounting bracket 88. Screws 98 can be inserted through holes in the side flanges 94 of the brackets 88 to secure the beams. Likewise, a screw can be inserted through the hole 78 in the bottom support flange 74 of each bracket 62 to secure the beams 50. Also, adjacent beams 50 can be joined by screws at suitable locations along the length of the beams 50.

With the above steps accomplished, the basic gazebo structure 10 is properly in place. It is to be understood, of course, that additional steps could be undertaken. For example, as shown herein, the crossmembers 52 are spaced from one another, and the roof would normally be completed by placing shingles over the crossmembers 52. Further, various ornamental embellishments, such as decorative corner pieces could be installed at the juncture of the lower horizontal member 30 of the upper panels or sections 22 and the posts 18.

In the completed gazebo structure, it will be noted that each of the brackets 62 is positioned between the longitudinal axes of adjacent roof sections 42. Further, each bracket 62 faces toward a related corner location of the regular polygon defined by the base structure 12.

It is to be understood that various modifications could be made without departing from the basic teachings of the present invention.

What is claimed and desired to be secured by Letters Patent of the United States is:

1. A building assembly adapted for quick erection into an assembled position to form a building structure, said assembly comprising:

(a) a side support structure adapted to be erected in a configuration defining a perimeter of said structure, and defining a plurality of support locations positioned around said perimeter;

(b) a roof center piece adapted to be positioned at an apex location within said perimeter, (c) a plurality of roof sections, each roof section having a base portion of a greater width dimension, an apex portion of a lesser width dimension, first and second side portions extending from opposite ends of said base portion inwardly toward one another to said apex portion, and a logitudinal center axis extending from a middle location of said base portion to said apex portion, said roof sections being adapted to be placed in said assembled position in side-by-side relationship around said apex location to form a roof structure, with each roof section having its base portion at a respective support location of said perimeter frame and its apex portion adjacent said roof center piece, and with its longitudinal axis extending radially from said apex location, (d) each of said roof sections having first and second elongate side beams positions at said first and second side portions, respectively, and having a base end at said base portion and an apex end at apex portion, each beam having a laterally and outwardly facing contact face, with the contact face of a first beam of each roof section being positioned adjacent the contact face of a second beam of an adjacent roof section when said roof sections are in said assembled position, and with the apex portions of each of said first and second adjacent beams being adjacent one another and having a predetermined width dimension, (e) said center piece having a plurality of mounting elements positioned around a perimeter of said center piece, each mounting element having a pair of side flange portions defining an outwardly facing receiving slot of a predetermined horizontal width dimension sized to receive in close-fitting relationship a related pair of apex portions of adjacent first and second beams to two adjacent roof sections, (f) said assembly being characterized in that with the assembly in the assembled position, each of said mounting elements of the center piece is positioned between the longitudinal axes of two adjacent roof sections in a position to receive the apex ends of a related first and second beams of adjacent roof sections, in a manner to securely position the apex ends of said related first and second beams against one another and with the first and second apex portions of beams of any one roof section fitting in adjacent mounting elements.

(g) said center piece being further characterized in that adjacent flange portions of each pair of adjacent mounting elements extend radially outwardly from said apex location so as to be diverging radially outwardly from one another in a manner that side surfaces of said adjacent flange portions are able to engage inwardly facing surface portions of the apex ends of the side beams of a related one of said roof sections in snug fitting relationship in a manner that the related one of said roof sections is in secure engagement with said center piece.

2. The assembly as recited in claim 1, wherein each mounting element has a lower flange portion that extends radially outwardly in a downward slant to engage lower slanted surfaces of first and second beams positioned in the slot defined by that mounting element.

3. The assembly as recited in claim 2, wherein each mounting element comprises a back mounting plate by which that mounting element is mounted to said center piece.

4. The assembly as recited in claim 1, wherein said center piece comprises a hub portion having a plurality of generally vertical planar outwardly facing surfaces positioned around a perimeter of the hub, each of said mounting elements having a generally U-shaped configuration comprising a generally planar back plate portion connected to said side flange portions, and also connected directly to a related surface of the hub.

5. The assembly as recited in claim 1, wherein each mounting element has a lower flange portion that extends radially outwardly in a downward slant to engage lower slanted surfaces of first and second beams positioned in the slot defined by that mounting element.

6. The assembly as recited in claim 1, wherein said side support structure comprises a plurality of posts adapted to be vertically aligned in said assembled position, with each post having an upper support end engaging in support relationship a related pair of first and second beams of two adjacent roof sections, with at least some of said posts having generally planar side surface portions, said assembly further comprising panel sections which in the assembled position are positioned between two related posts, each panel section having side planar surfaces engaging a related two of said posts, in a manner that the side surfaces of the panel sections engaging the side surfaces of the posts positioned said posts and said panels in the configuration that defines the perimeter of said structure.

7. The assembly as recited in claim 6, wherein the configuration defining the perimeter of the structure is a regular polygon, having side lines and corner locations, with each of said posts being positioned at a corner location, each post being positioned so that side surfaces of each post are generally radially aligned with said apex location.

8. The assembly as recited in claim 1, wherein:

(a) each mounting element has a lower flange portion that extends radially outwardly in a downward plant to engage lower slanted surfaces of first and second beams positioned in the slot defined by that mounting element, and also comprises a back mounting late by which the mounting element is mounted to the center piece, (b) said center piece further comprises a hub portion having a plurality of generally vertical planar outwardly facing surfaces positioned around a perimeter of the hub portion, each of said mounting elements having a generally U-shaped configuration, and the back plate is connected to the side flange portions, and also connected directly to a related surface of the hub portion, (c) said side support structure comprises a plurality of posts adapted to be vertically aligned in said assembled position, with each post having an upper support end engaging in support relationship a related pair of first and second beams of two adjacent roof sections, with at least some of said posts having generally planar side surface portions, said assembly further comprising panel sections which in the assembled position are positioned between two related posts, each panel section having side planar surfaces engaging a related two of said posts, in a manner that the side surfaces of the panel sections engaging the side surfaces of the posts positioned said posts and said panels in the configuration that defines the perimeter of said structure.

(d) the configuration defining the perimeter of the structure is a regular polygon, having side lines and corner locations, with each of said posts being positioned at a corner location, each post being positioned so that side surfaces of each post are generally radially aligned with said apex location.

9. A building structure which can be quickly and easily erected, said structure comprising:

(a) a side support structure arranged in a configuration defining a perimeter of said structure, and defining a plurality of support locations positioned around said perimeter;

(b) a roof center piece positioned at an apex location within said perimeter, (c) a plurality of roof sections, each roof section having a base portion of a greater width dimension, an apex portion of a lesser width dimension, first and second side portions extending from opposite ends of said base portion inwardly toward one another to said apex portion, and a longitudinal center axis extending from a middle location of said base portion to said apex portion, said roof sections being placed in said assembled position in side-by-side relationship around said apex location to form a roof structure, with each roof section having its base portion at a respective support location of said perimeter frame and its apex portion adjacent said roof center piece, and with its longitudinal axis extending radially from said apex location, (d) each of said roof sections having first and second elongate side beams positioned at said first and second side portions, respectively, and having a base end at said base portion and an apex end at the apex portion, each beam having a laterally and outwardly facing contact face, with the contact face of a first beam of each roof section being positioned adjacent the contact face of a second beam of an adjacent roof section when said roof sections are in said assembled position, and with the apex portions of each of said first and second adjacent beams being adjacent one another and having a predetermined width dimension, (e) said center piece having a plurality of mounting elements positioned around a perimeter of said center piece, each mounting element having a pair of side flange portions defining an outwardly facing receiving slot of a predetermined horizontal width dimension receiving in close-fitting relationship a related pair of apex ends of adjacent first and second beams of two adjacent roof sections, in a manner to securely position the apex ends of said realted first and second beams against one another.

(f) said assembly being characterized in that each of said mounting elements of the center piece is positioned between the longitudinal axes of two adjacent roof sections in a position to receive the apex ends of a related first and second beams of adjacent roof sections, and with the first and second apex portions of beams of any one roof section fitting in adjacent mounting elements.

(g) said center piece being further characterized in that adjacent flange portions of each pair of adjacent mounting elements extend radially outwardly from said apex location so as to be diverging radially outwardly from one another in a manner that side surfaces of said adjacent flange portions are able to engage inwardly facing surface portions of the apex ends of the side beams of a related one of said roof sections in snug fitting relationship in a manner that the related one of said roof sections is in secure engagement with said center piece.

10. The structure as recited in claim 9, wherein each mounting element has a lower flange portion that extends radially outwardly in a downward slant to engage lower slanted surfaces of first and second beams positioned in the slot defined by that mounting element.

11. The assembly as recited in claim 10, wherein each mounting element comprises a back mounting plate by which that mounting element is mounted to said center piece.

12. The assembly as recited in claim 9, wherein said center piece comprises a hub portion having a plurality of generally vertical planar outwardly facing surfaces positioned around a perimeter of the hub portion, each of said mounting elements having a generally U-shaped configuration comprising a generally planar back plate portion connected to said side flange portions, and also connected directly to a related surface of the hub.

13. The assembly as recited in claim 12, wherein each mounting element has a lower flange portion that extends radially outwardly in a downward slant to engage lower slanted surfaces of first and second beams positioned in the slot defined by that mounting element.

14. The assembly as recited in claim 1, wherein said side support structure comprises a plurality of posts adapted to be vertically aligned in said assembled position, with each post having an upper support end engaging in support relationship a related pair of first and second beams of two adjacent roof sections, with at least some of said posts having generally planar side surface portions, said assembly further comprising panel sections which are positioned between two related posts, each panel section having side planar surfaces engaging a related two of said posts, in a manner that the side surfaces of the panel sections engaging the side surfaces of the posts positioned said posts and said panels in the configuration that defines the perimeter of said structure.

15. The assembly as recited in claim 14, wherein the configuration defining the perimeter of the structure is a regular polygon, having side lines and corner locations, with each of said posts being positioned at a corner location, each post being positioned so that side surfaces of each post are generally radially aligned with said apex location.

16. The structure as recited in claim 9, wherein:

(a) each mounting element has a lower flange portion that extends radially outwardly in a downward slant to engage lower slanted surfaces of first and second beams positioned in the slot defined by that mounting element, and also comprises a back mounting plate by which the mounting element is mounted to the center piece, (b) said center piece further comprises a hub portion having a plurality of generally vertical planar outwardly facing surfaces positioned around a perimeter of the hub portion, each of said mounting elements having a generally U-shaped configuration, and the back plate is connected to the side flange portions, and also connected directly to a related surface of the hub portion, (c) said side support structure comprises a plurality of posts adapted to be vertically aligned in said assembled position, with each post having an upper support end engaging in support relationship a related pair of first and second beams of two adjacent roof sections, with at least some of said posts having generally planar side surface portions, said assembly further comprising panel sections which in the assembled position are positioned between two related posts, each panel section having side planar surfaces engaging a related two of said posts, in a manner that the side surfaces of the panel sections engaging the side surfaces of the posts positioned said posts and said panels in the configuration that defines the perimeter of said structure, (d) the configuration defining the perimeter of the structure is a regular polygon, having side lines and corner locations, with each of said posts being positioned at a corner location, each post being positioned so that side surfaces of each post are generally radially aligned with said apex location.

17. A method of erecting a building assembly into an assembled position to form a building structure, said method comprising:

(a) erecting a side support structure in a configuration defining a perimeter of said structure, and defining a plurality of support locations positioned around said perimeter;

(b) providing a roof center piece adapted to be positioned at an apex location within said perimeter, (c) providing a plurality of roof sections, each roof section having a base portion of a greater width dimension, an apex portion of a lesser width dimension, first and second side portions extending from opposite ends of said base portion inwardly toward one another to said apex portion, and a longitudinal center axis extending from a middle location of said base portion to said apex portion, said roof sections being adapted to be placed in said assembled position in side-by-side relationship around said apex location to form a roof structure, with each roof section having its base portion at a respective support location of said perimeter frame and its apex portion adjacent said roof center piece, and with its longitudinal axis extending radially from said apex location, and each of said roof sections having first and second elongate side beams positioned at said first and second side portions, respectively, and having a base end at said base portion and an apex end at the apex portion, each beam having a laterally and outwardly facing contact face, with the contact face of a first beam of each roof section being positioned adjacent the contact face of a second beam of an adjacent roof section when said roof sections are in said assembled position, and with the apex portions of each of said first and second adjacent beams being adjacent one another and having a predetermined width dimension, (d) providing said center piece with a plurality of mounting elements positioned around a perimeter of said center piece, each mounting element having a pair of side flange portions defining an outwardly facing receiving slot of a predetermined horizontal width dimension sized to receive in close-fitting relationship a related pair of apex portions of adjacent first and second beams of two adjacent roof sections, said center piece being characterized in that adjacent flange portions of each pair of adjacent mounting elements extend radially outwardly from said apex location so as to be diverging radially outwardly from one another in a manner that side surfaces of said adjacent flange portions are able to engage inwardly facing surface portions of the apex ends of the side beams of a related one of said roof sections in snug fitting relationship in a manner that the related one of said roof sections is in secure engagement with said center piece.

(e) placing the apex portion of one of said roof sections into engagement with said center piece by placing the first and second apex ends of the beams of that roof section into engagement with two adjacent mounting elements, and placing said roof section with said center piece engaged therewith with the base portion of the roof section positioned on a support location of the side support structure, (f) placing a second one of said roof sections on said side support structure with the base portion of the second one of said roof sections positioned at a second one of said support locations, and with the apex ends of the two beams of the second one of the roof sections engaging two of the mounting elements, (g) mounting additional roof sections onto the base structure so that the apex portions of the additional roof sections come into engagement with related ones of the mounting elements, and the base portions of said additional roof sections are positioned at related support locations on the side support structure.

18. The method as recited in claim 17, wherein the second one of said roof sections is positioned oppositely to the first roof section that is positioned on said side support structure, with the first and second roof sections cooperating with said center piece to enable said first and second roof sections to support one another.

* * * * *